US005956981A

United States Patent [19]

Weisburn et al.

[11] Patent Number: 5,956,981

[45] **Date of Patent: *Sep. 28, 1999**

[54] UNIVERSAL OPENER

[75] Inventors: James T. Weisburn, Massillon; Matthew P. Williams, N. Canton, both of Ohio

[73] Assignee: Alpha Enterprises, Inc., North Canton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/800,585

[22] Filed: Feb. 18, 1997

[51] Int. Cl.[6] ..... B65D 85/57

[52] U.S. Cl. ..... 70/57.1; 70/58; 70/63; 206/1.5; 206/308.2; 206/387.11

[58] Field of Search ..... 70/57, 57.1, 58, 70/63, 387; 206/1.5, 308.2, 387.11

[56] References Cited

U.S. PATENT DOCUMENTS

| | | | |
|---|---|---|---|
| 1,525,947 | 2/1925 | Mitchell | 70/63 |
| 3,125,873 | 3/1964 | Robinson | 70/63 |
| 3,659,442 | 5/1972 | Cellini et al. | 70/63 |
| 3,820,654 | 6/1974 | Colella | 206/1.5 |
| 4,527,310 | 7/1985 | Vandebult | 70/57.1 |
| 4,834,238 | 5/1989 | Hehn et al. | 70/63 X |
| 5,069,047 | 12/1991 | Lynch et al. | 70/57.1 |
| 5,129,244 | 7/1992 | Wittman | 70/57.1 |
| 5,205,401 | 4/1993 | Weisburn et al. | 206/1.5 |
| 5,215,188 | 6/1993 | Wittman | 206/1.5 |
| 5,215,189 | 6/1993 | Weisburn et al. | 206/1.5 |
| 5,255,543 | 10/1993 | Wittman | 70/57.1 |
| 5,261,259 | 11/1993 | Ployd | 70/58 |
| 5,295,576 | 3/1994 | Wang | 206/1.5 X |
| 5,372,020 | 12/1994 | Stoltz et al. | 70/57.1 |
| 5,375,708 | 12/1994 | Wittman | 206/1.5 X |
| 5,375,712 | 12/1994 | Weisburn | 206/387.11 |
| 5,390,515 | 2/1995 | Essick | 70/63 |
| 5,460,266 | 10/1995 | Mundorf et al. | 206/309 |
| 5,535,606 | 7/1996 | Nguyen et al. | 70/57.1 |

FOREIGN PATENT DOCUMENTS

| | | | |
|---|---|---|---|
| 461049 | 12/1991 | European Pat. Off. | 206/105 |

*Primary Examiner*—Lloyd A. Gall
*Attorney, Agent, or Firm*—Sand & Sebolt

[57] ABSTRACT

A universal opener for use with security packages used in conjunction with cases containing compact discs, audio cassettes, video cassettes, and video game cartridges. The universal opener has three sets of three pins each, that are spaced apart so as to unlock security packages of differing designs, sizes, uses, and arrangements. The universal opener also having a lock thereon for disabling the pins such that unlocking of the security packages is prohibited.

8 Claims, 16 Drawing Sheets

UNIVERSAL OPENER

BACKGROUND OF THE INVENTION

1. Technical Field

The present invention relates to a device for opening security packages. More particularly, the present invention relates to a device for easily opening security packages such as those used to prevent theft of audio cassettes, video cassettes, compact discs, video games, or other small recorded media which are easily stolen from a retail outlet. Specifically, the present invention relates to a universal opener capable of opening a variety of security packages of different constructions for securably displaying audio cassettes, video cassettes, compact discs, video games, and other small recorded media so as to prevent theft thereof.

2. Background Information

In recent years, the demand by consumers for new recorded media has been phenomenal. Specifically, record discs and 8-track tapes of previous generations have been replaced by much smaller audio cassettes and compact discs that possess significantly better sound quality. In addition, today's overall demand for recorded media and specifically audio cassettes and compact discs has far surpassed the demands for recorded media in the past. Furthermore, video cassettes and video game cartridges have also become increasingly popular. Thus, all of these new forms of recorded media have been very successful in the marketplace.

However, along with this success in the marketplace comes shoplifting and other forms of theft. The small size of these newer forms of recorded media has added significantly to the risk of theft. Specifically, compact discs are very thin while audio cassettes and video game cartridges are very small, and as a result all of these are susceptible to unauthorized removal, particularly since they can easily fit in a in a coat pocket or other hidden area within or under a clothing article or in a purse or shopping bag. For these reasons there has been a need to secure small and relatively expensive audio and video recorded media within security packages so as to inhibit shoplifting and other theft. Numerous devices have been invented for this purpose such as shown in U.S. Pat. Nos. 5,215,188, 5,460,266, 5,205,401, 5,390,515, D333,563, 5,221,283,4,760,914, and 4,865,190. Each of these security packages has been ideally suited for this purpose. In addition, many are reusable and have proven to be a very effective and inexpensive way of preventing theft of various recorded media including audio cassettes, video cassettes, compact discs, and video game cartridges.

However, in the past each security device has required its own separate unlocking mechanism, typically embodied as some form of key. Therefore, even if all of the same security packages are used for alike recorded media, a recorded media store would still have several varying security packages based upon its sales of audio cassettes, video cassettes, compact discs, video game cartridges, and other recorded media and therefore would at a minimum have several keys.

It has also been found that often these key elements are susceptible to breakage. It was also found that some were difficult to use.

In response, other security packages were developed which used more substantial openers rather than keys such as those disclosed in U.S. Pat. Nos. 5,129,244 and 5,255,543. These openers are typically slightly more bulky which prevented each from being lost or stolen because of their size. Each of these openers can also be conveniently placed near the checkout counter so as to unlock the specific security packages they were designed for.

However, prior art keys and openers were typically each designed and configured so as to be capable of opening only one specific type of security package. Therefore, it was still a requirement to have multiple keys or openers available for clerks throughout the store and at the checkout counters so as to provide access to all of the various recorded media stored in the various security packages. A need therefore exists for a universal key or opener that is capable of opening various types of security packages for a wide array of different recorded media including audio cassettes, video cassettes, compact discs, video game cartridges, and other recorded media.

Furthermore, many of these openers are conveniently positioned adjacent the checkout area of the stores. However, often not all the checkout counters are active. Therefore, these openers must either be left unattended or removed from publicly accessible spaces.

A need thus exists for an opener that may be left out and in some embodiments secured to a checkout counter without the concern of the opener being left unattended. Specifically, a need exists to be able to deactivate or lock the opener.

SUMMARY OF THE INVENTION

Objectives of the invention include providing an improved unlocking device for security packages.

A further objective is to provide a device for rapidly, easily, and effectively opening security packages of a reusable nature that are used in retail outlets to protect various types of recorded media from theft.

A further objective is to provide an opener capable of opening security packages of differing sizes, differing contents, and/or differing locking mechanisms.

A further objective is to provide an opening device that is selectively disabled so as to allow said opener to remain publicly accessible but unusable when opening is not desired.

A further objective is to provide an opener for opening security packages where the opener is inexpensive.

A further objective is to provide an opener for opening security packages where the opener is easy to use.

A further objective is to provide an opening mechanism that can be part of an opening body securable to a fixed counter or other structure, or part of a hand held unit.

These and other objectives and advantages of the invention are obtained by the improved universal opener of the invention used for unlocking, opening or otherwise providing access to a security package holding and displaying some form of recorded media such as audio cassettes, video cassettes, compact discs, or video game cartridges, the general nature of which may be stated as including a base and a plurality of unlocking elements. The base is for selectively receiving the security package with the article therein when the security package is in a locked position. The base has an article receiving surface. The plurality of unlocking elements extend outward from the article receiving surface. The unlocking elements are grouped into at least two spaced apart sets.

BRIEF DESCRIPTION OF THE DRAWINGS

Preferred embodiments of the invention, illustrative of the best modes in which applicants have contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 1:
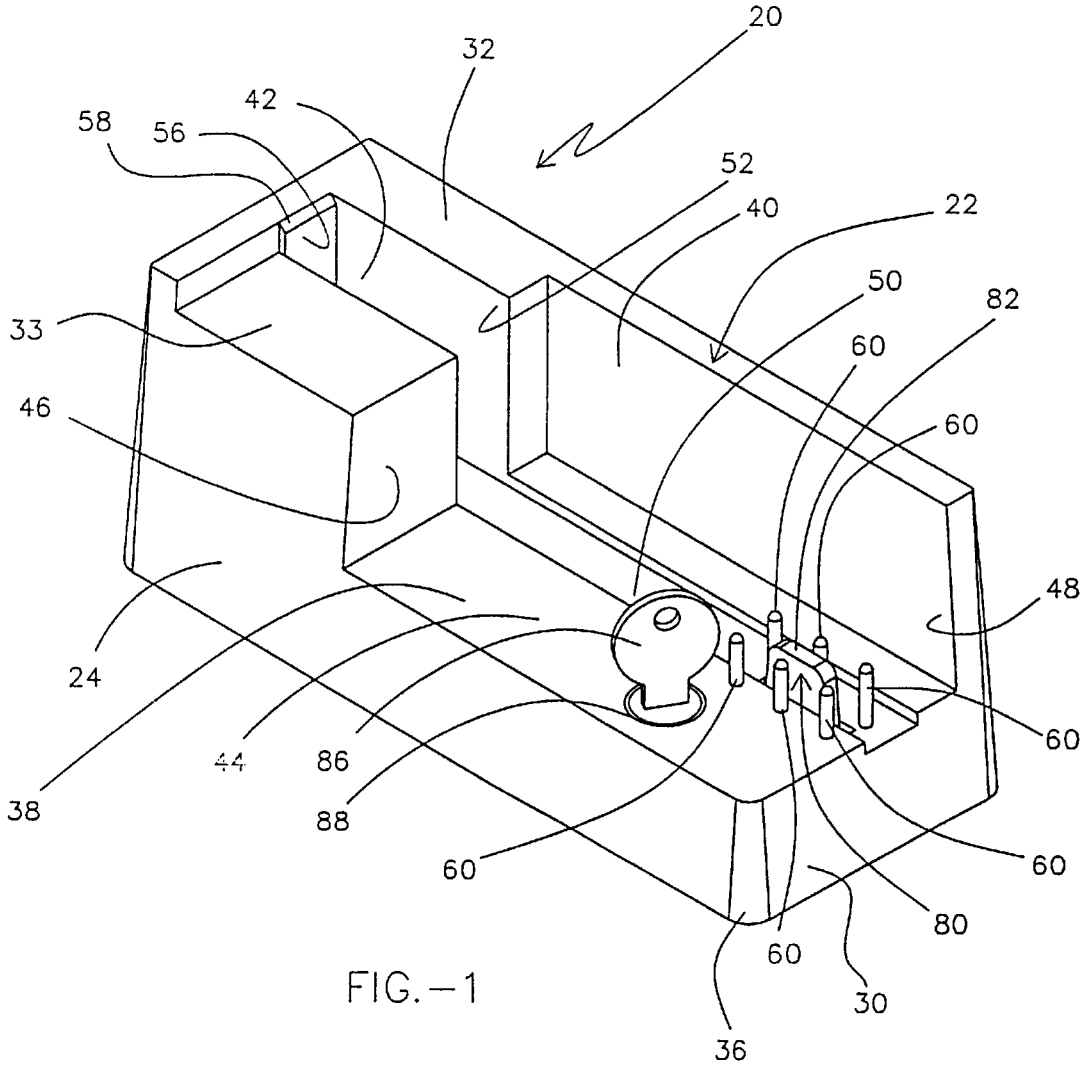
FIG. 1 is a perspective view of a first embodiment of the universal opener of the present ion, where the lock is in a locked position.
Figure 2:
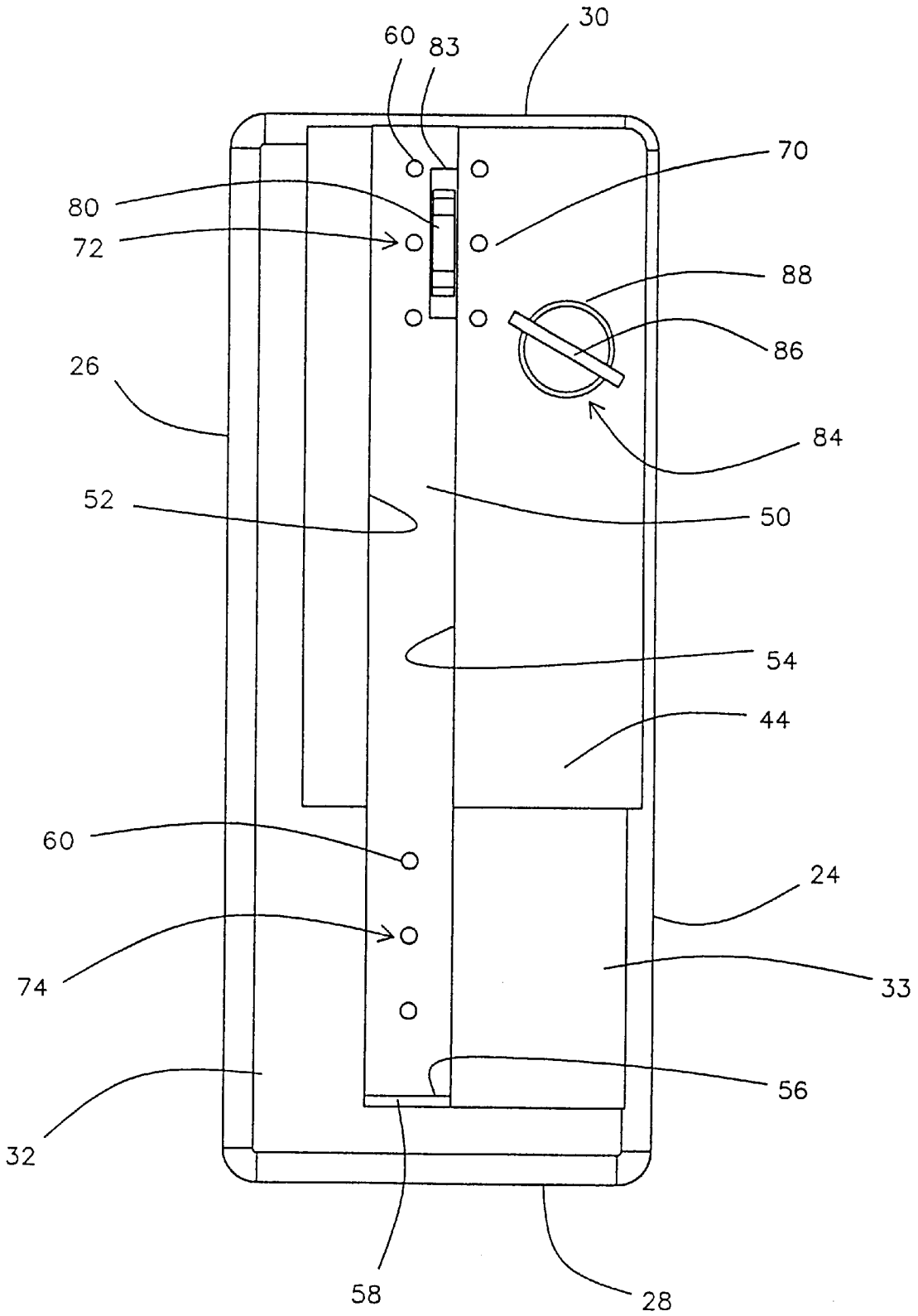
FIG. 2 is a top plan view of the universal opener of FIG. 1.

The improved universal opener of the present invention is shown in several embodiments, the first of which is indicated generally at 20 and is shown particularly in FIGS. 1–15. As is best shown in FIG. 1, universal opener 20 has a main housing or body 22 that includes a front 24, a back 26, a large end 28, a small end 30, a top 32, and a base 34. In some embodiments including the displayed embodiment, part of top 32 has a sunken area 33.

In one embodiment, rounded corners 36 transition front 24 to each of ends 28 and 30, and back 26 to each of ends 28 and 30, although these corners could also be approximately 90 degree sharp-edged transitions. As to the transition from top 32 to front 24, back 26, and ends 28 and 30, and the transition from base 34 to front 24, back 26, and ends 28 and 30, the contour is sharper although the contour may be a smooth rounded transition or a sharp 90 degree. Also, in the displayed embodiment, front 24, back 26, and ends 28 and 30 taper inward as each extends upward from base 34 toward top 32, although such taper is not functionally required.

In accordance with one of the main features of the invention, main housing 22 further includes a security package cut-out 38 for receiving various types and sizes of security packages to be opened or unlocked by universal opener 20. Cutout out 38 includes a corner notch 40 with an elongated thin groove 42 extending slightly further downward and significantly further inward into housing 22 toward end 28.

Corner notch 40 is a cut-out of one of the corners of the housing 22. In the embodiment shown, the corner cut away is the corner where front 24, end 30, and top 32 would have intersected. Corner notch 40 includes a notch base 44, a notch end 46, and a notch back 48.

Groove 42 splits corner notch 40 across notch base 44 and notch end 46. Groove 42 extends only slightly into notch base 44 as is shown in FIG. 1 while extending significantly into notch end 46 to almost end 30 as is also shown in FIG. 1. Groove 42 includes a groove base 50, a pair of opposed and parallel groove walls 52 and 54, and a groove end 56. Groove walls 52 and 54 are of a small height along notch base 44 defining a slight depression within notch base 44 while of a large height along top 32 defining a narrow and deep channel in top 32 and notch end 46. Groove 42 also includes a tapered edge 58 between groove end 56 and top 32.

In accordance with another of the main features of the invention, a plurality of pins or fingers 60 extend outward from cut-out 38 on main housing 22. Each pin 60 is preferably an elongated cylinder extending perpendicularly upward from either groove base 50 or notch base 44. Each pin 60 may have either a rounded tip or end, or alternatively may terminate in a pointed or sharpened end.

In accordance with another related feature of the invention, these pins 60 are grouped in sets, such as sets of three, as is shown in the displayed embodiment of FIGS. 1–4. Specifically, universal opener 20 includes three sets 70, 72 and 74 of pins 60. Each set of three pins is planar, that is each pin extends from one of bases 50 or 44 in a planar manner with respect to the other pins within the set.

In the most preferred embodiment as is shown in FIGS. 1–4, sets 72 and 74 are planar with each other as both extend from groove base 50. Set 70 extends from notch base 44 and is in a plane spaced apart and parallel to the plane of sets 72 and 74.

In accordance with yet another feature of the invention, universal opener 20 includes a lock 80 for blocking access to one or more of the pins thereby prohibiting insertion of a security package thereon and thus preventing unlocking or opening of this security package.

Figure 3:
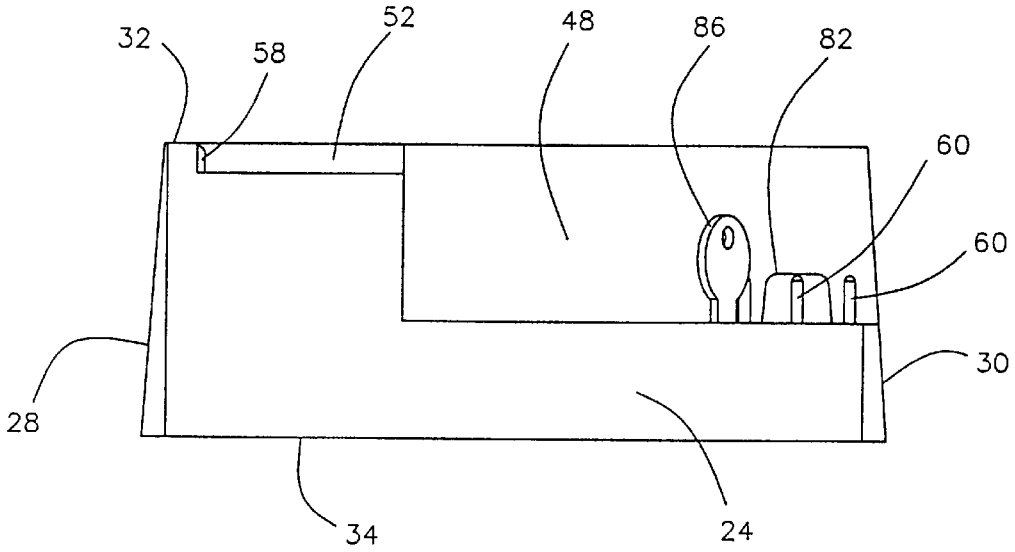
FIG. 3 is a front elevational view of the universal opener of FIG. 1.
Figure 4:
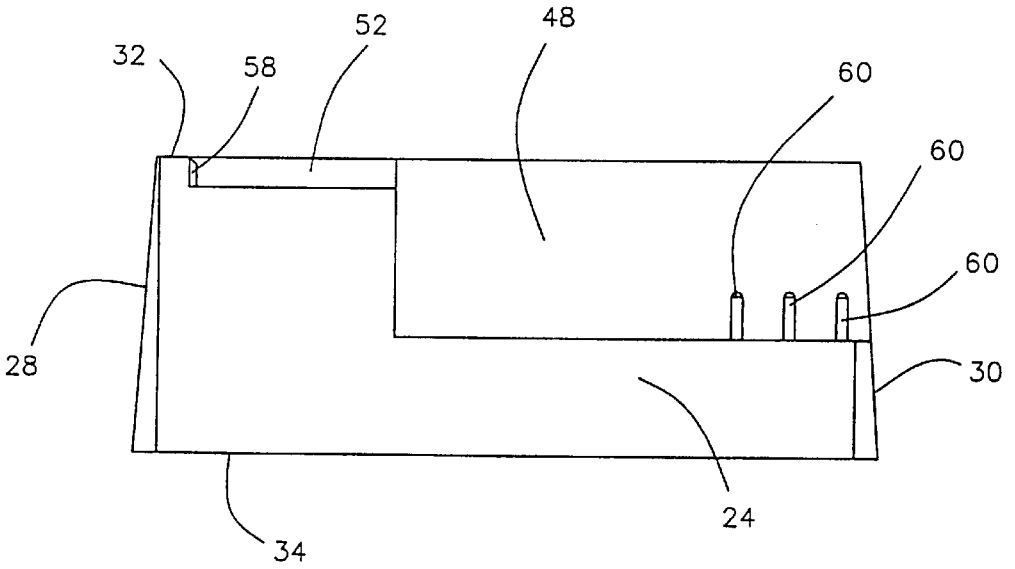
FIG. 4 is the same front plan view of the universal opener as shown in FIG. 3 except that the lock is in an unlocked position and the key is removed.

Lock 80 includes a locking tab 82 actuated by a lock actuator 84 via a locking mechanism within housing 22 (not shown). Locking tab 82 is selectively extendable outward from a slot 83 in groove base 50 in between finger set 70 and finger set 72 thereby prohibiting pins 60 on sets 70 and 72 from receiving a security package to be opened. The lock actuator 84 in the displayed embodiment is a key 86 and key lock 88 which is responsible for the movement of tab 82 from a locked position as is shown in FIG. 3 with tab 82 extended and an unlocked position as shown in FIG. 4 with the tab 82 retracted. This key lock 88 with a keyhole therein may be located in any of a number of locations including in notch base 44, front 24, end 30, and back 26.

Figure 5:
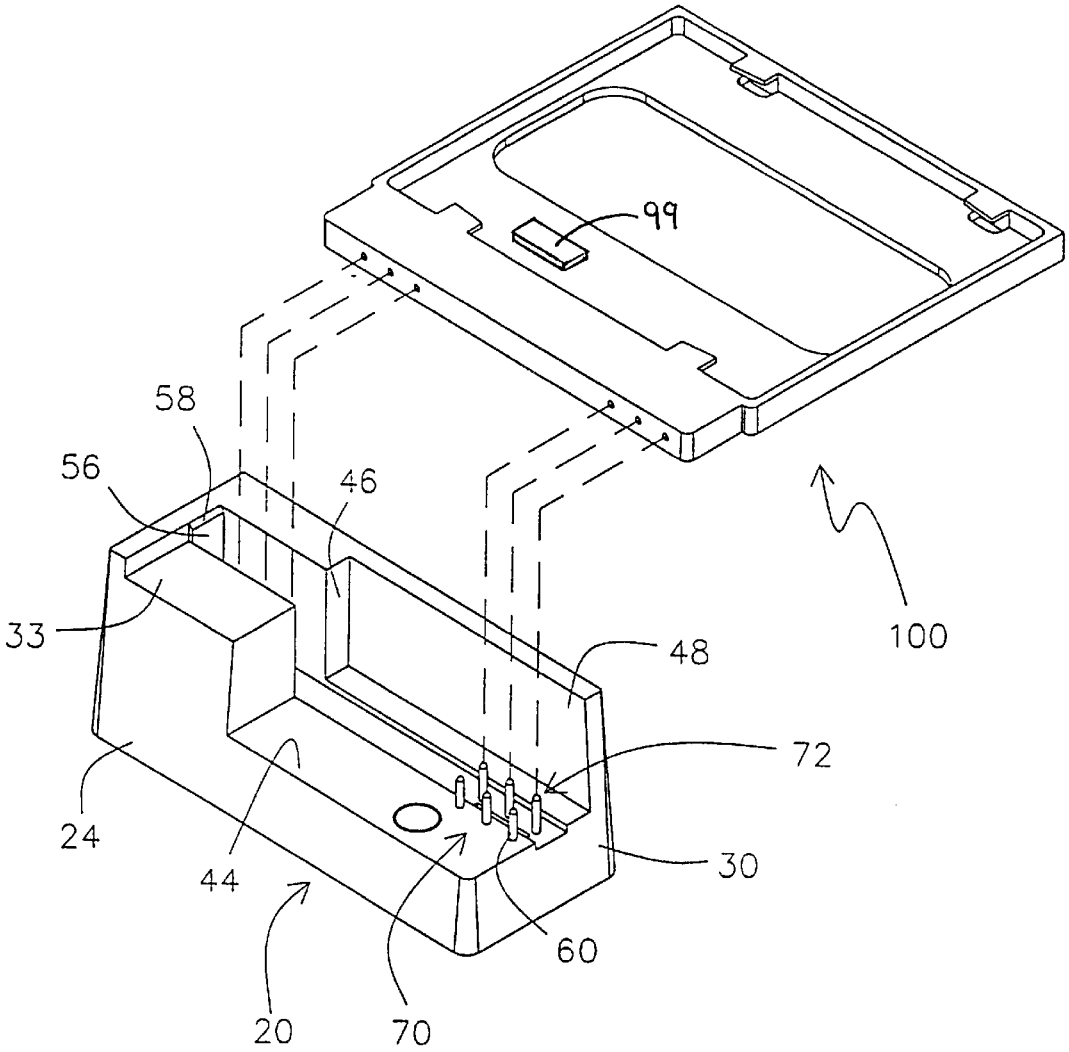
FIG. 5 is a perspective view of the universal opener of FIG. 1 with a compact disk and jewel case security package aligned therewith.
Figure 6:
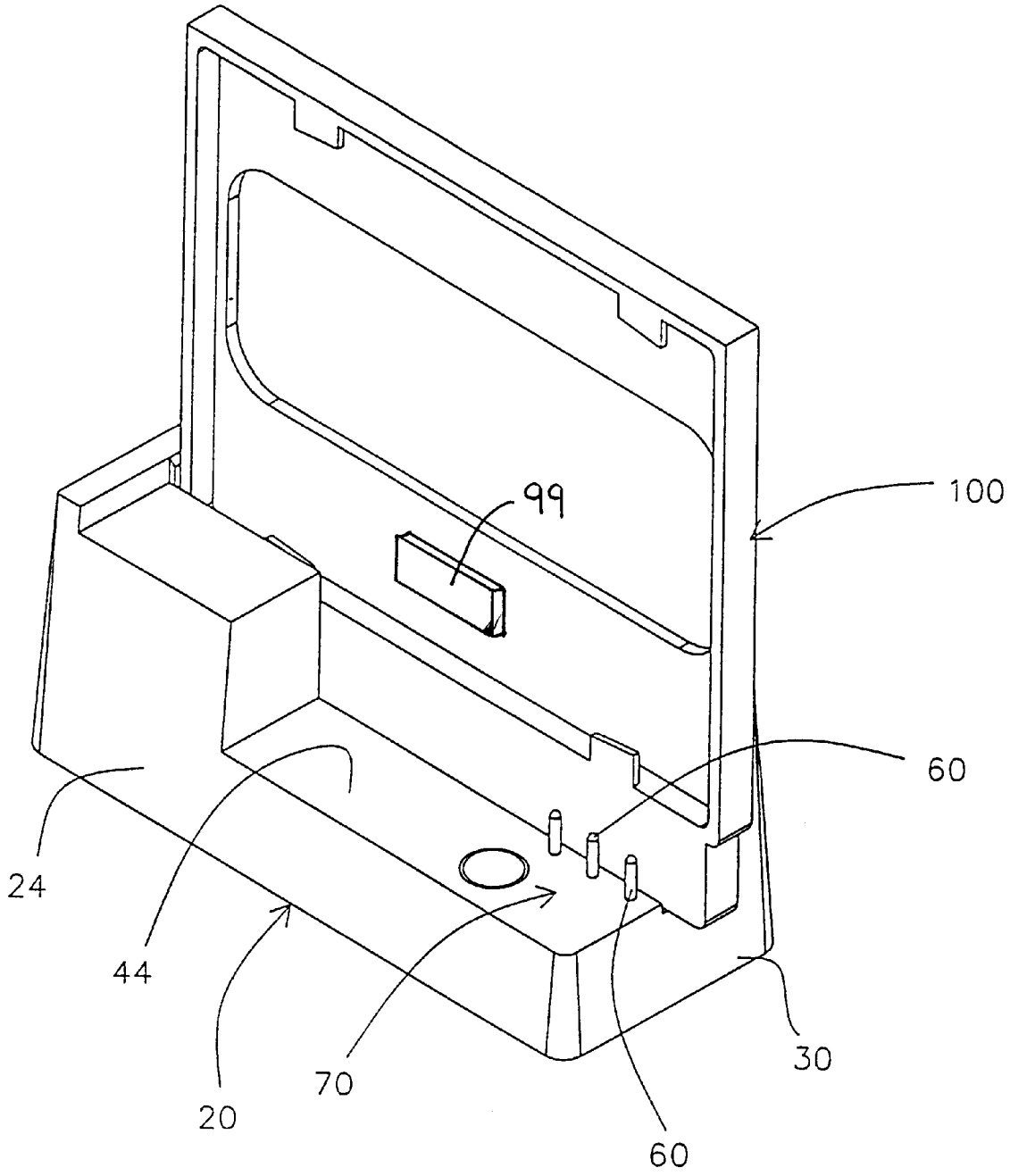
FIG. 6 is a perspective view of the universal opener and security package of FIG. 5 with the security package engaged within the universal opener.
Figure 7:
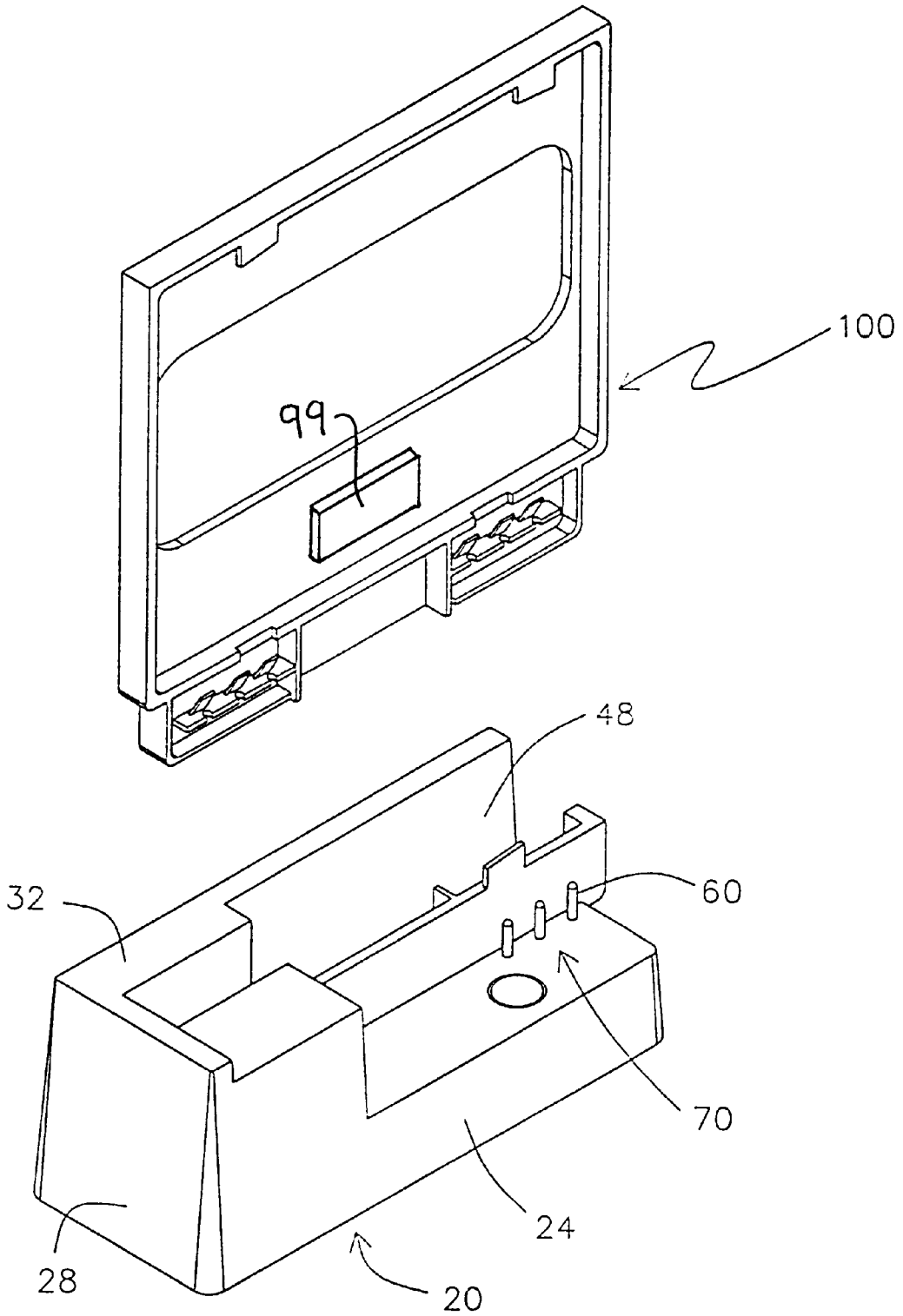
FIG. 7 is a different perspective view of the universal opener and security package of FIGS. 5 and 6 with the security package unlocked and separated such that any compact disk within any jewel case that was in the security package is readily removable.
Figure 8:
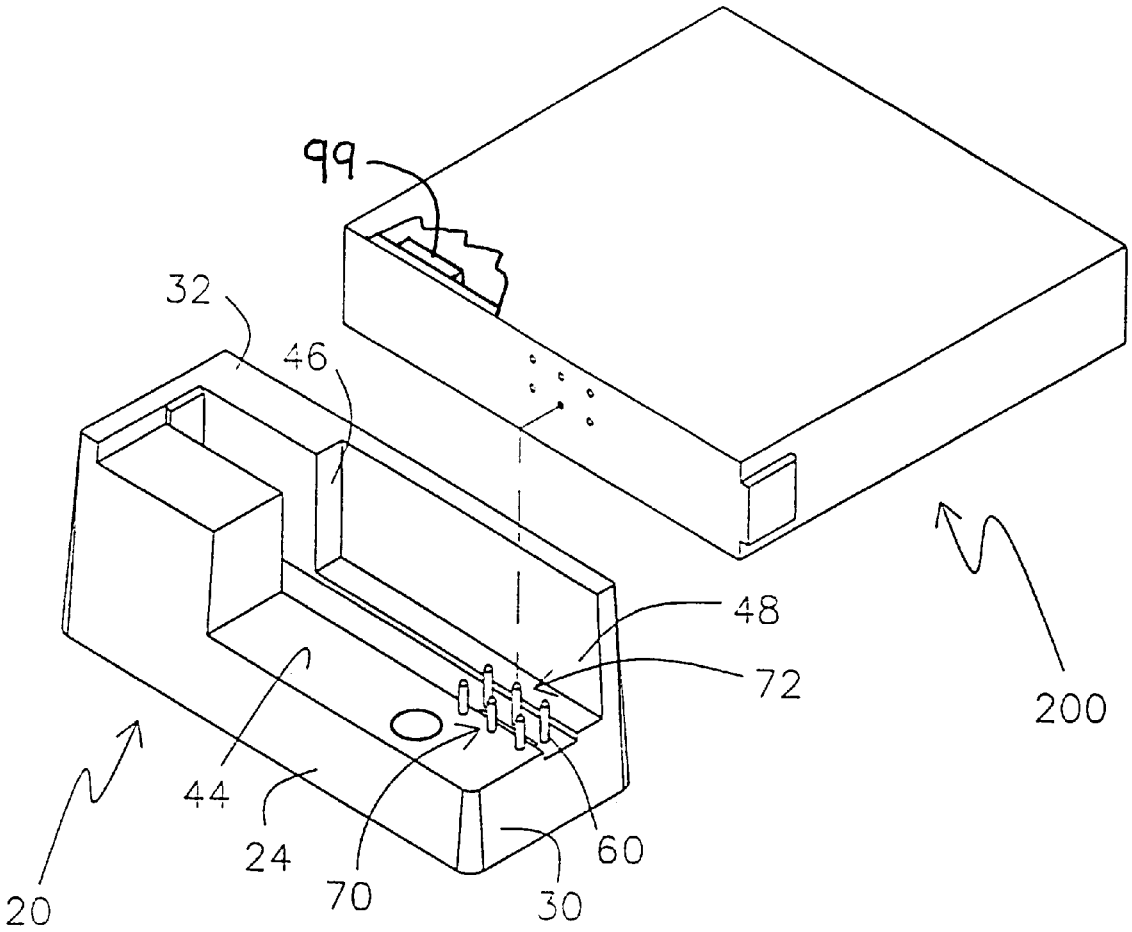
FIG. 8 is a perspective view of the universal opener of FIG. 1 with a double or twin jewel case security package aligned therewith.
Figure 9:
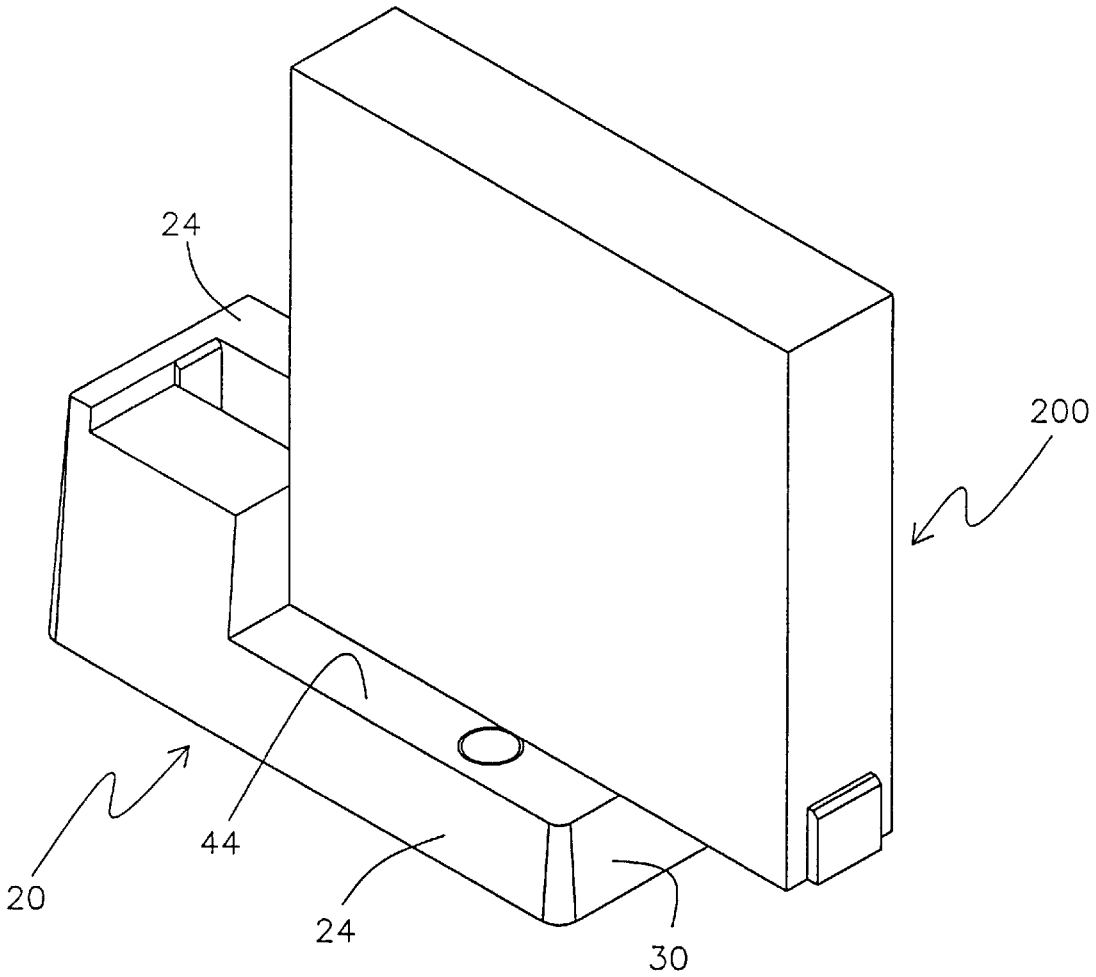
FIG. 9 is a perspective view of the universal opener and double jewel case security package with two compact discs therein of FIG. 8 in an engaged position.
Figure 10:
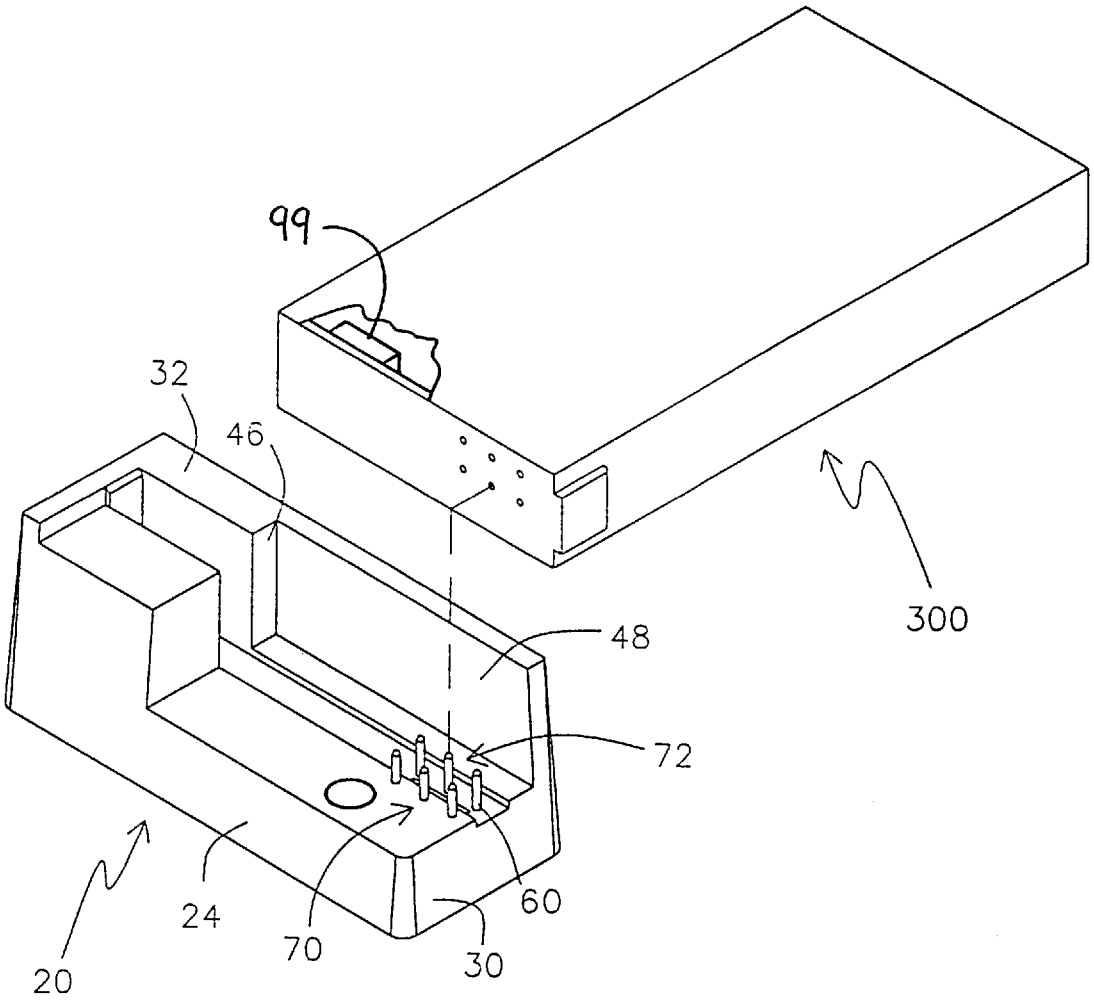
FIG. 10 is a perspective view of the universal opener of FIG. 1 with a video cassette security package aligned therewith.
Figure 11:
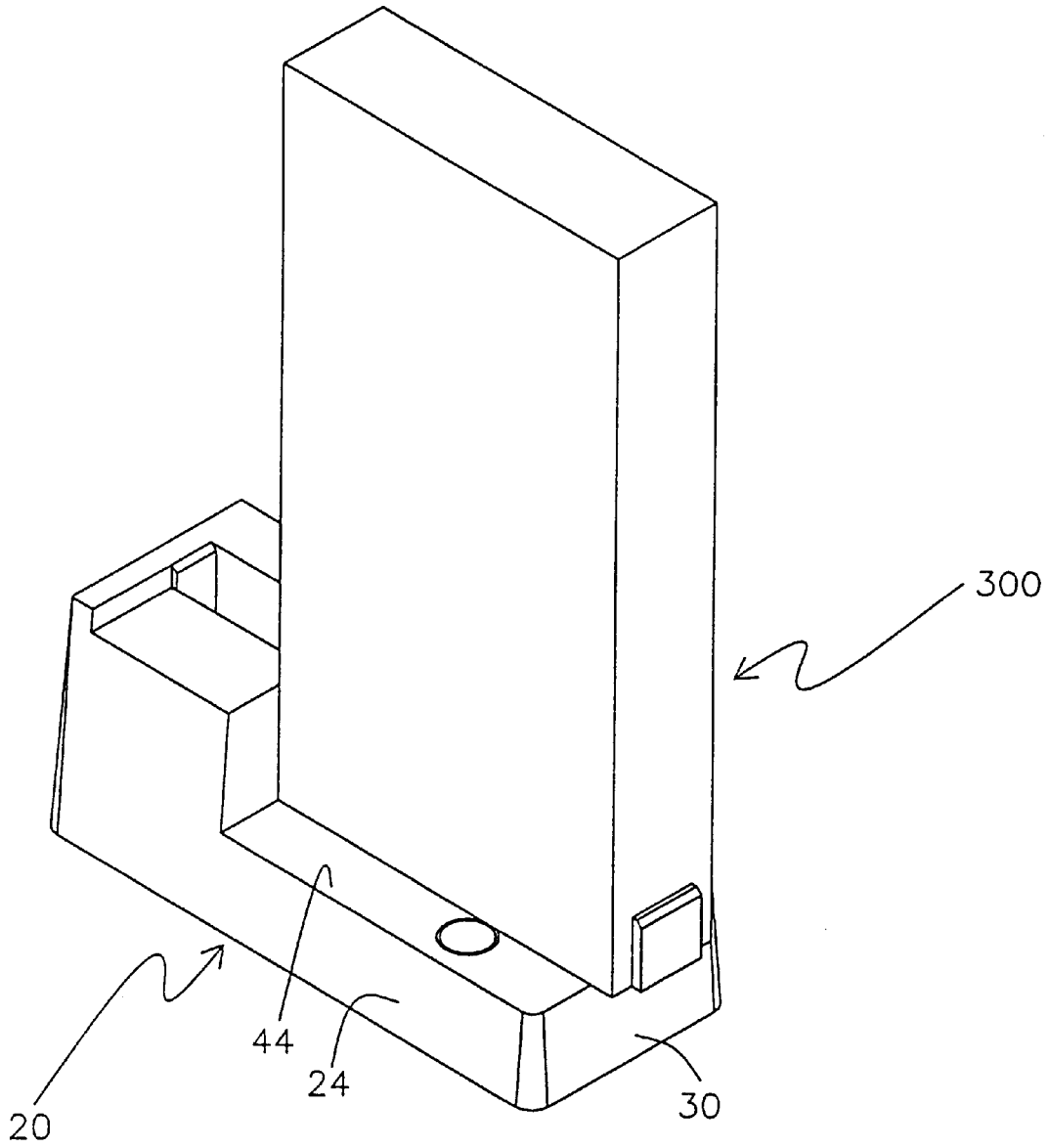
FIG. 11 is a perspective view of the universal opener and video cassette security package of FIG. 10 in an engaged position.
Figure 12:
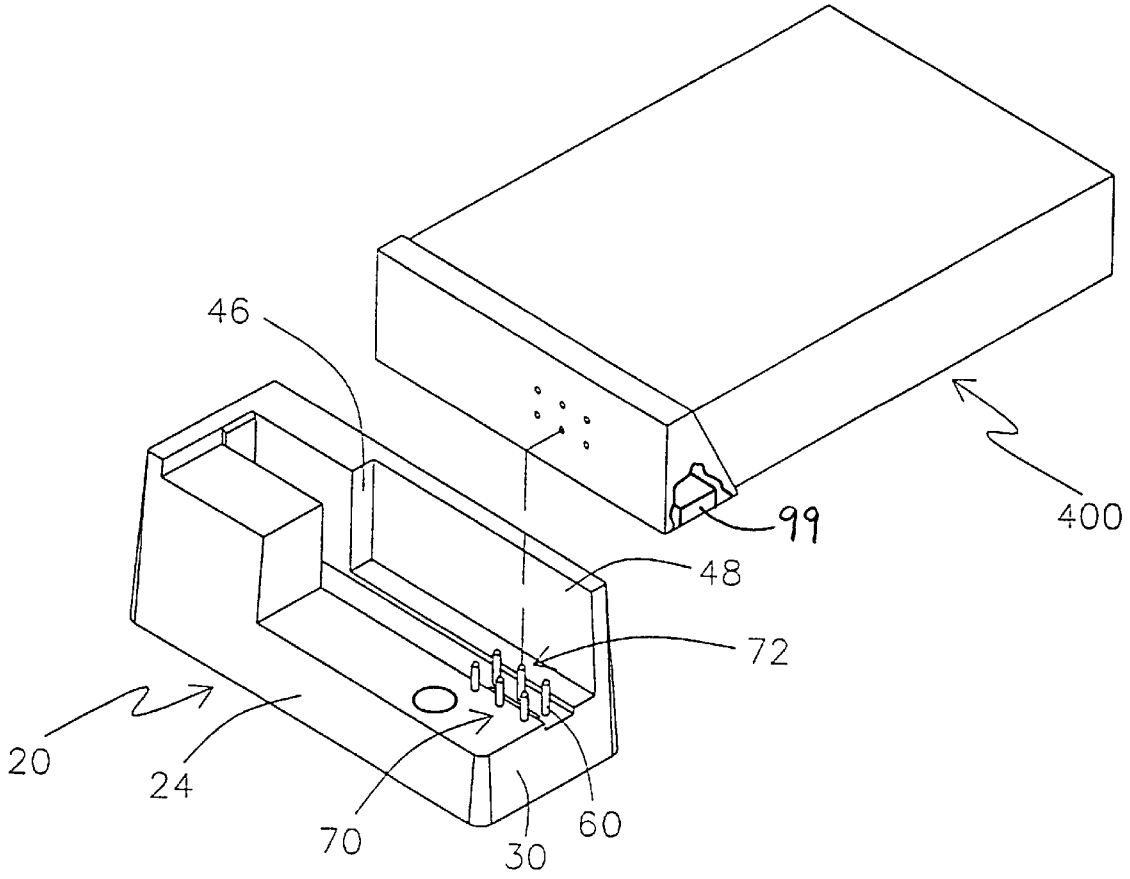
FIG. 12 perspective view of the universal opener of FIG. 1 aligned with a video game cartridge security package.
Figure 13:
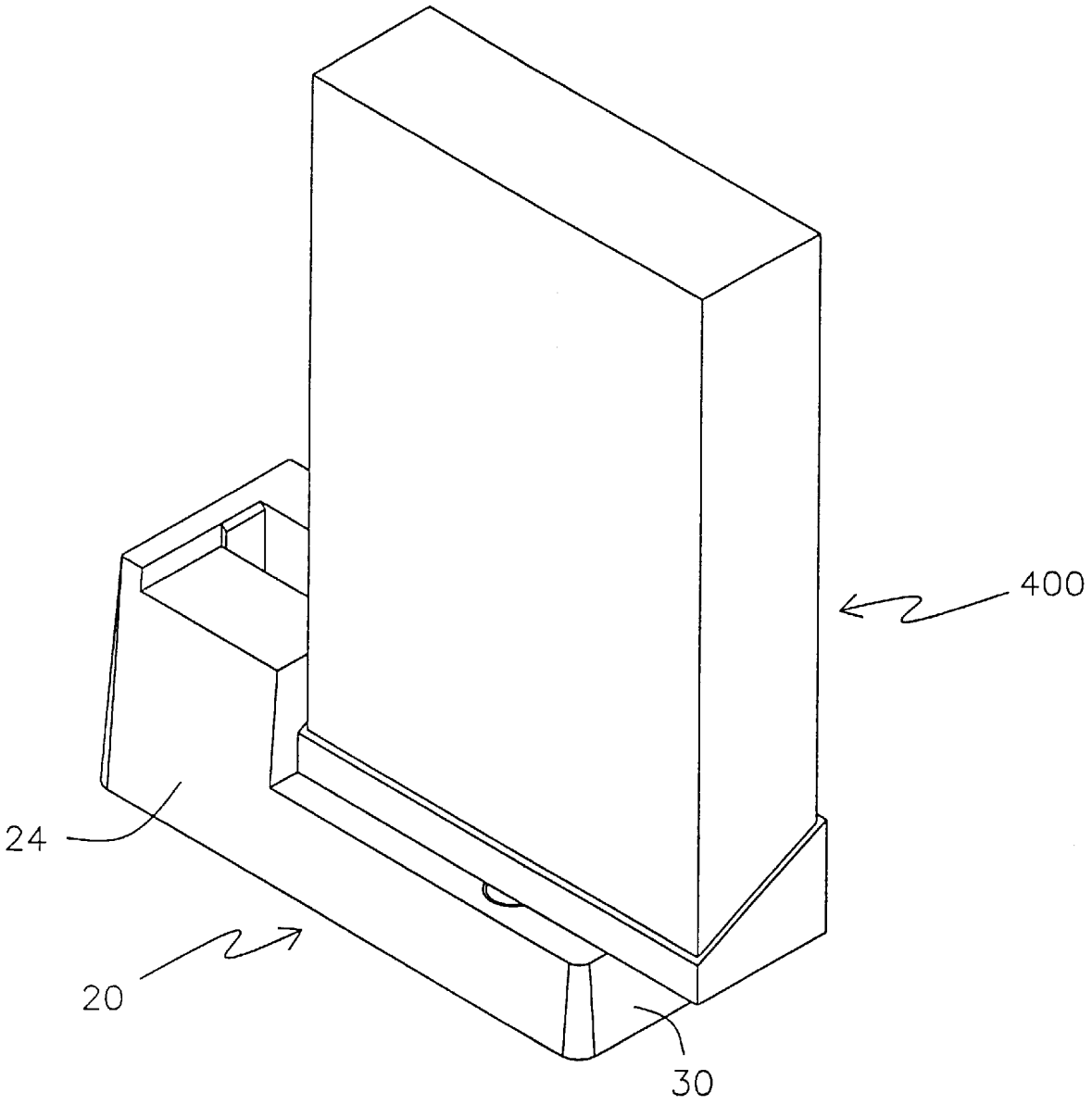
FIG. 13 is a perspective view of the universal opener and the video game cartridge security kage of FIG. 12 in an engaged position.
Figure 14:
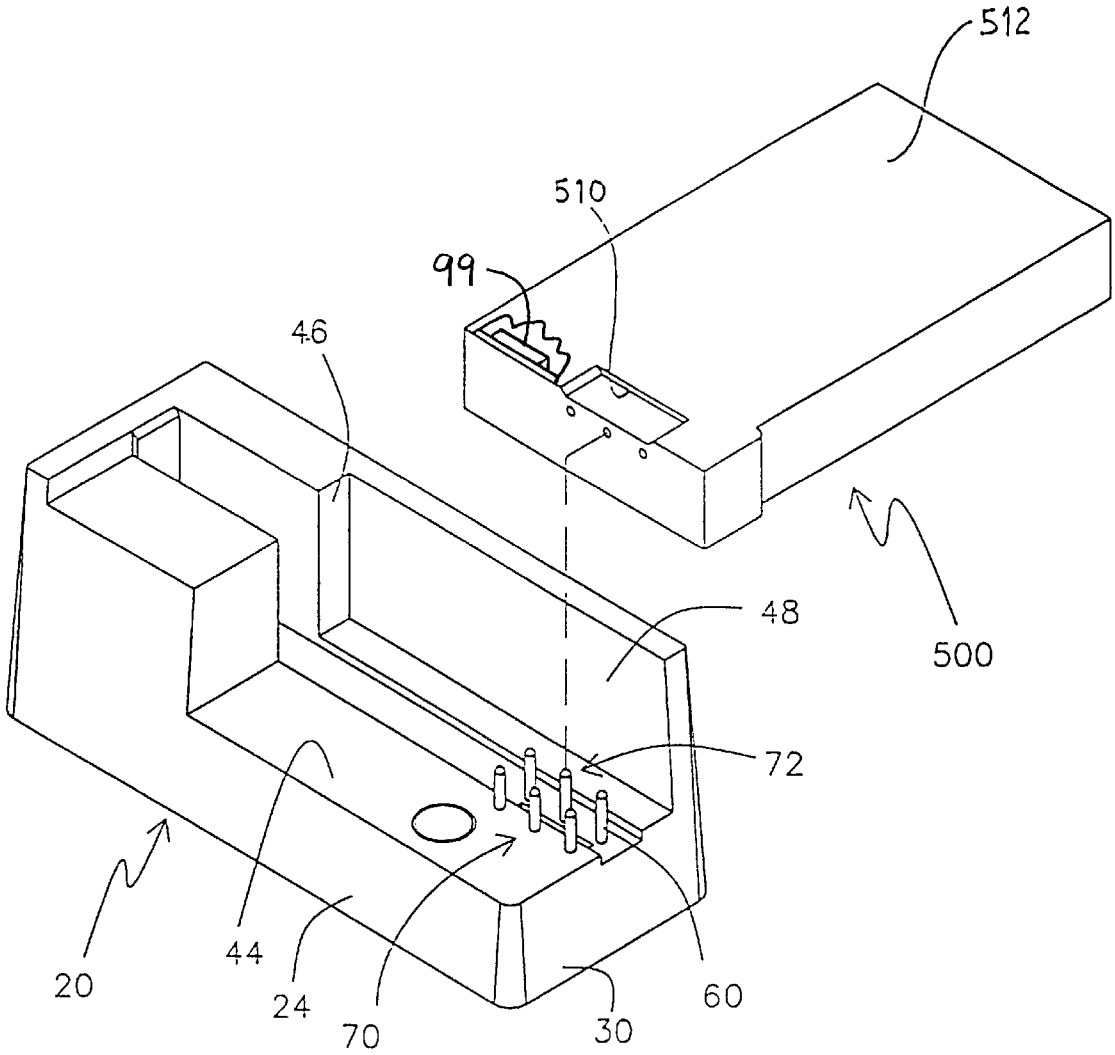
FIG. 14 is a perspective view of the universal opener of FIG. 1 aligned with an audio cassette security package.
Figure 15:
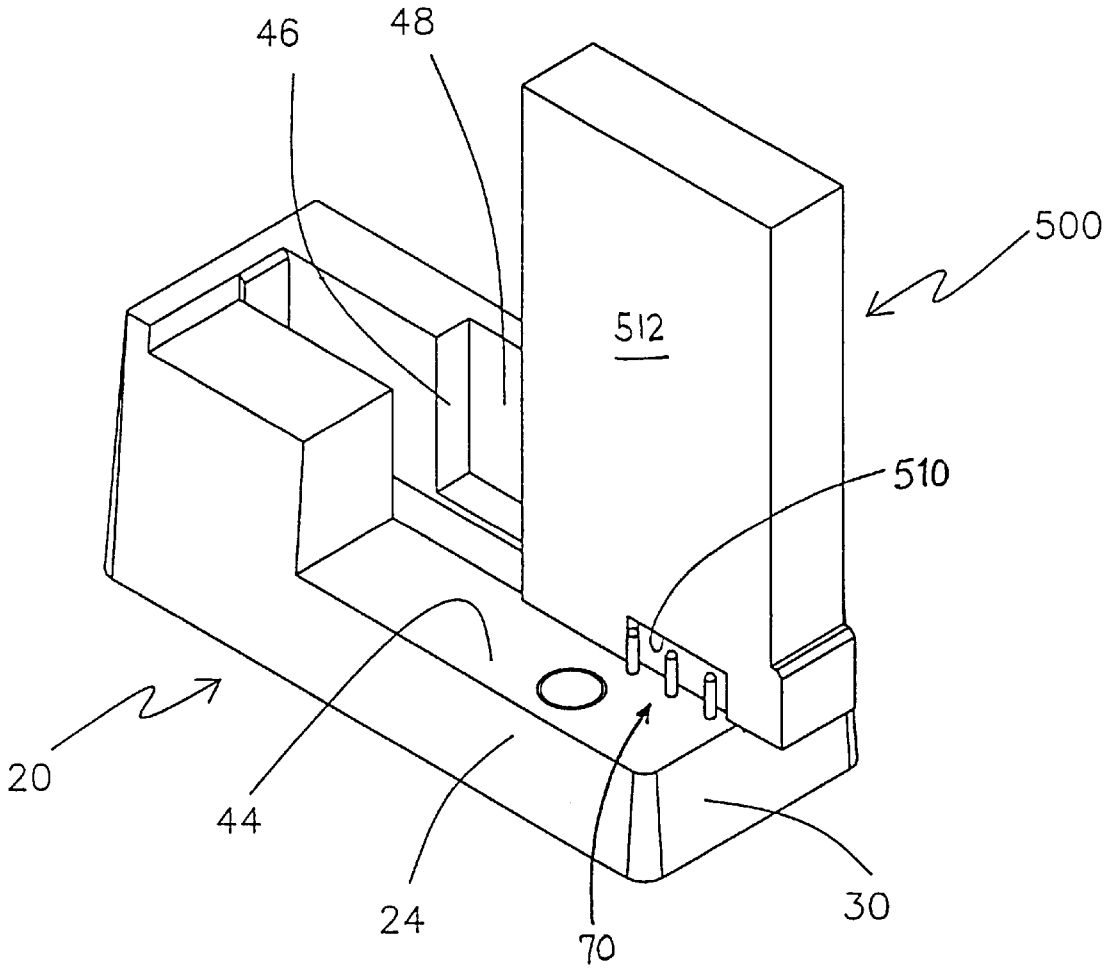
FIG. 15 is a perspective view of the universal opener and cassette security package of FIG. 14 an engaged position.

In operation, various types and sizes of security packages may be opened using universal opener 20 including a security package 100 for a single jewel case that holds and displays a compact disc as is shown in FIGS. 5–7, a security package 200 for a double jewel case that holds and displays a pair of compact discs as is shown in FIGS. 8–9, a security package 300 for a video cassette case that holds and displays a video cassette such as a VHS tape as is shown in FIGS. 10–11, a security package 400 for a video game case that holds and displays a video game cartridge as is shown in FIGS. 12–13, and a security package 500 for an audio cassette case that holds and displays audio cassettes as is shown in FIGS. 14–15.

Each security package 100, 200, 300, 400, 500 includes apertures in its outer case that provide access to a recorded media securing mechanism therein. The securing mechanism holds the security package together thereby securing the recorded media therein. Since each security package contains a hidden and unaccessible electronic article surveillance (EAS) tag 99, the overall package is theftproof unless the recorded media and its case is removed from the package such as at sale. It is these apertures that provide limited access to the securing mechanism so as to open or unlock the security package. Therefore, these apertures must correlate in size, dimension, shape, and arrangement to a specific lock or key so as to allow this opening or unlocking.

In one example of universal opener 20 and related security packages, universal opener 20 includes the nine pins 60 as described above. The pins 60 are grouped in the three sets 70, 72, pins 60 in each set a as described above. The pins 60 in each set are approximately one (1) centimeter apart from each other. The pins of sets 72 and 74 form a first plane approximately centered within groove 50. The pins of set 70 are spaced apart from and in a second plane parallel to the first plane of the pins of set 72. In addition, the first pin of set 70 forms a plane with the first pin of set 72 that is substantially perpendicular to the first plane. The second pin of set 70 forms a plane with the second pin of set 72 that is substantially perpendicular to the first plane. The third pin of set 70 forms a plane with the third pin of set 72 that is substantially perpendicular to the first plane. The first and second planes are approximately one (1) centimeter apart from each other. The distance between the closest pins in sets 72 and 74 is approximately seven (7) centimeters.

As is shown in FIGS. 5–9 for a compact disc security package 100 or 200, FIGS. 10–11 for a video cassette security package 300, FIGS. 12–13 for a video game security package 400, and FIGS. 14–15 for an audio cassette security package 500, the apertures that provide access to the securing mechanism are alignable with some of the pins in the universal opener 20 as is shown in FIGS. 5, 8, 10, 12, and 14 while avoiding any other pins. When removal of the recorded media is desired, locking tab 82 is retracted into housing 22 by operation of key 86, thereby providing unimpeded access to the pins of sets 70 and 72. The security package is then engaged with the universal opener 20 in the desired and appropriate manner as shown in FIGS. 6, 9, 11,13, and 15 whereby selected pins 60 disengage the securing mechanism within the security package 100, 200, 300, 400, 500 thereby allowing separation of the security package, or opening of a door therein, or other disablement that allows access to the recorded media and its case from within the security package. One example of this package separation is shown in FIG. 7 for a single jewel case.

In the case of a single compact disc security package (FIG. 5), 100 is inserted within groove 42 whereby the package is aligned by tapered edge 58 during insertion. The security package when fully inserted rests against groove base 50 in between groove walls 52 and 54 and against groove end 56 as is shown in FIG. 6. The pins of sets 72 and 74 are used to open the security package 100.

In the case of a double compact disc security package, the package 200 may include a lower case portion identical to package 100 and thereby similarly insertable, or in the alternative, may as shown in FIGS. 8–9, be inserted within notch 40. The security package when fully inserted rests against notch base 44 and along notch end 46 and notch back 48. The pins of sets 70 and 72 are used to open the security package 200.

In the case of a video cassette security package 300 (FIGS. 10 and 11), the package is inserted within notch 40. The security package when fully inserted rests against notch base 44 and along notch end 46 and notch back 48. The pins of sets 70 and 72 are used to open the security package 300.

In the case of a video game cartridge security package, the package 400 is inserted within notch 40 (FIGS. 12 and 13). The security package when fully inserted rests against notch base 44 and along notch end 46 and notch back 48. The pins of sets 70 and 72 are used to open the security package 400.

In the case of an audio cassette security package (FIGS. 14 and 15), package 500 is inserted within notch 40. The security package when fully inserted rests against notch base 44 and along notch back 48 only. The pins of set 72 are used to open the security package 500. A notch 510 is formed in a side wall 512 of package 500 for receiving pin set 70 therein so as not to interfere with the engagement of the package with pin set 72.

Figure 16:
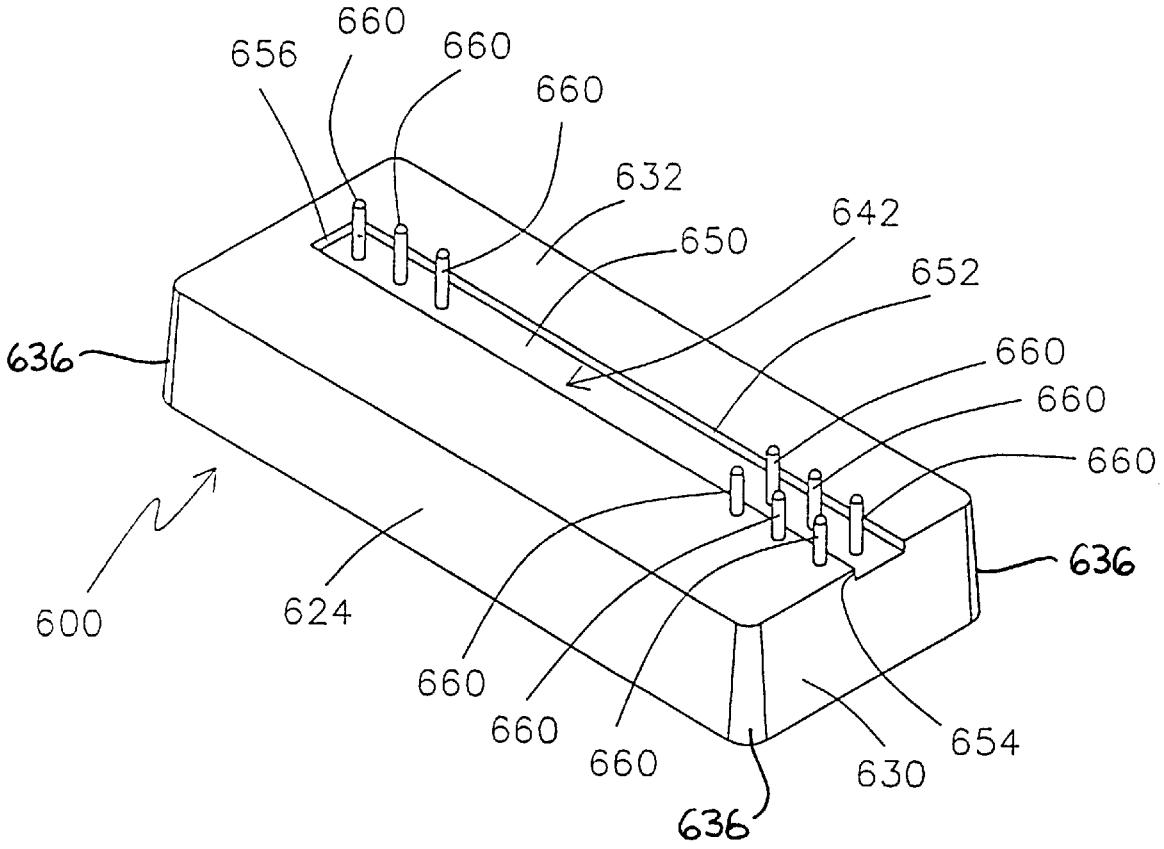
FIG. 16 a perspective view of a second embodiment of the universal opener.
Figure 17:
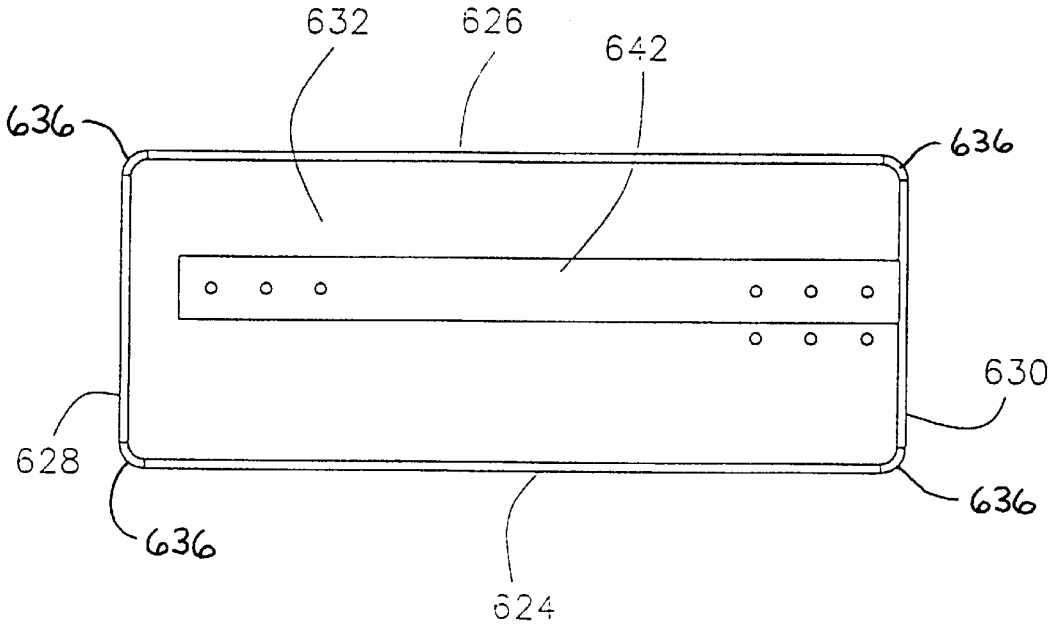
FIG. 17 is a top plan view of the universal opener of FIG. 16.
Figure 18:
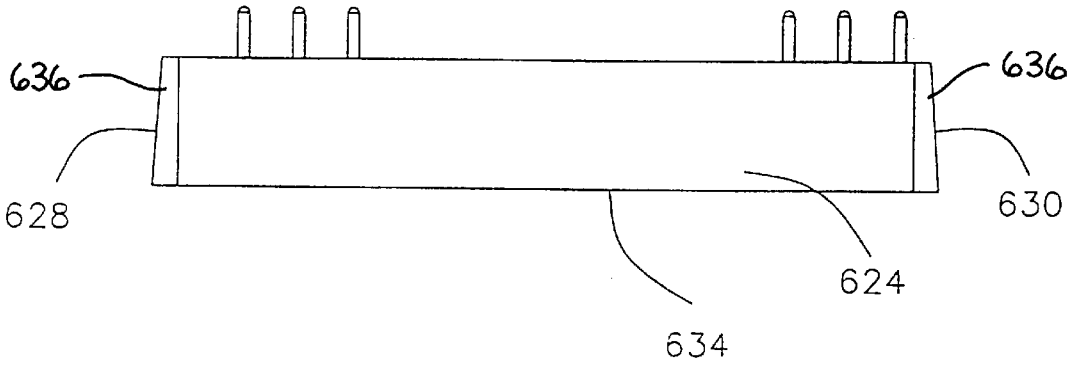
FIG. 18 is a front elevational view of the universal opener of FIG. 16.

Another embodiment of the invention is shown in FIGS. 16–18 and is indicated as universal opener 600. Universal opener 600 is either a hand held or smaller model of universal opener 20.

Universal opener 600 is similar to universal opener 20 except universal opener 600 only includes a front 624, a back 626, ends 628 and 630, a base 634, and a top 632 with a groove 642 therein. Each of front 624, back 626, and ends 628 and 630 abut both top 632 and base 634. In addition, the transition between front 624 and ends 628 and 630, and between back 626 and ends 628 and 630 is a rounded corner 636.

Groove 642 extends from end 630 to almost end 628. Groove 642 is defined by a groove base 650, a pair of opposed and parallel groove walls 652 and 654, and a groove end 656. Groove walls 652 and 654 are of a small height such that groove 642 only extends minimally into top 632.

A plurality of pins or fingers 660 extend outward from top 632 and groove 642. Each pin 660 is preferably an elongated cylinder extending perpendicularly upward from either top 632 or groove 642. Each pin 660 may have either a rounded tip or end, or alternatively may terminate in a pointed or sharpened end.

In accordance with another related feature of the invention, these pins 660 are preferably grouped in sets, such as sets of three, as is shown in the displayed embodiment of FIGS. 16–18. The groupings are the same as in the previous described embodiment. Universal opener 600 may also include a lock as described above in the previous embodiment for blocking access to one or more of the pins thereby prohibiting insertion of a security package thereon and thus preventing unlocking or opening of this security package.

One example of an opener such as 20 is dimensioned as follows. The overall depth from front 24 to back 26 is approximately two to two and one-half inches. The overall width from end 28 to end 30 is approximately six to six and onehalf inches. The overall height from base 34 to top 32 is approximately two and one-half inches.

Corner notch 40 extends two to almost two and one-half inches into opener 20 from front 24, three to three and one-half inches into opener 20 from end 30, and one to one and one-half inches into opener 20 from top 32.

This groove 42 extends downward into notch base 44 between one thirty-second and one-quarter of an inch. Thin groove 42 also extends beyond notch end 46 by one and one-half to two inches.

Pins 60 are between approximately one-quarter and one-half inch tall. The distance between the closest pins in sets 72 and 74 is approximately two and one-half inches to three inches while sets 70 and 72 are separated by between one-quarter and one-half of an inch. Each pin in each set is separated from an adjacent pin by between approximately one-quarter and three-quarters of an inch.

Accordingly, the improved universal opener for opening various types of security packages is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the universal key for opening various types of security packages is constructed and used, the characteristics of the construction, and the advantageous, new and useful results obtained; the new and useful structures, devices, elements, arrangements, parts and combinations, are set forth in the appended claims.

We claim:

1. A universal opener for opening security packages that each securably hold an article, the security packages having different types of unlocking mechanisms, the opener comprising:

a base for selectively receiving a security package with an article therein when the security package is in a locked position, the base having a package receiving surface thereon;

a first set of unlocking elements planarly aligned and extending outward from the package receiving surface;

a second set of unlocking elements planarly aligned and extending outward from the package receiving surface;

a third set of unlocking elements planarly aligned and extending outward from the package receiving surface;

the first, second, and third sets of unlocking elements adapted to cooperate to allow security packages having different types of unlocking mechanisms to be unlocked with the universal opener;

each of the sets of unlocking elements including three elongated spaced apart pins;

said first and third sets of unlocking elements being planar with each other and spaced apart from each other;

said second and third sets of unlocking elements being disposed in parallel spaced apart planes;

the elements within each set being separated by between one-quarter and three-quarters of an inch; and the closest elements of each planarly aligned set being separated by between two and one-half and three inches and the closest elements of each parallel set being separated by between one-quarter and one-half of an inch.

2. A universal opener for opening security packages that each securably hold an article, the security packages having different types of unlocking mechanisms, the opener comprising:

a base for selectively receiving a security package with an article therein when the security package is in a locked position, the base having a package receiving surface thereon;

a first set of unlocking elements planarly aligned and extending outward from the package receiving surface;

a second set of unlocking elements planarly aligned and extending outward from the package receiving surface;

a third set of unlocking elements planarly aligned and extending outward from the package receiving surface;

the first, second, and third sets of unlocking elements adapted to cooperate to allow security packages having different types of unlocking mechanisms to be unlocked with the universal opener;

each of the sets of unlocking elements including three elongated spaced apart pins;

said first and third sets of unlocking elements being planar with each other and spaced apart from each other;

said second and third sets of unlocking elements being disposed in parallel spaced apart planes; and a lock for selectively blocking access to one or more of the plurality of unlocking elements.

3. The universal opener of claim 2 wherein the base further includes a cut-out having an elongated groove from which spaced apart first and third sets of unlocking elements extend.

4. The universal opener of claim 3 wherein the cut-out includes a notch in which part of the elongated groove extends and from which the second set of unlocking elements extends.

5. A universal opener for opening security packages that each securably hold an article, the security packages having different types of unlocking mechanisms, the opener comprising:

a base for selectively receiving a security package with an article therein when the security package is in a locked position, the base including a cut-out for selectively receiving at least one type of security package and having a package receiving surface thereon;

a plurality of unlocking elements extending outward from the package receiving surface; the unlocking elements adapted to cooperate to allow at least two locked security packages having different locking mechanisms to be unlocked with the universal opener;

the plurality of unlocking elements being grouped into three spaced apart sets including a first set of three aligned pins, a second set of three aligned pins, and a third set of three aligned pins;

the pins in each set being separated by between one-quarter and three-quarters inch;

the first and third sets being planar with the closest pins from each set being separated by between two and one-half inches and three inches; and the second and third sets of unlocking elements being parallel and spaced apart by between one-quarter and one-half inch.

6. The universal opener of claim 5 further comprising a lock for selectively blocking access to one or more of the plurality of unlocking elements.

7. The universal opener of claim 5 wherein the cut-out includes an elongated groove from which the spaced apart first and third sets of unlocking elements extend, and a notch in which part of the elongated groove extends and from which the second set of spaced apart elements extends.

8. A recorded media security system comprising:

a first storage container having a first locking mechanism, the first storage container adapted to retain a first recorded media storage container selectively in locked and unlocked configurations;

a second storage container having a second locking mechanism, the second storage container adapted to retain a second recorded media storage container selectively in locked and unlocked configurations;

a third storage container having a third locking mechanism, the third storage container adapted to retain a third recorded media storage container selectively in locked and unlocked configurations;

a universal opener for unlocking each of the first, second, and third locking mechanisms of the first, second, and third storage containers;

the universal opener having a storage container receiving surface having a plurality of unlocking elements extending outward therefrom, the unlocking elements being grouped into first, second, and third spaced apart sets with each set having three elongated pins;

the first, second, and third pin sets positioned and configured to unlock each of the first, second and third locking mechanisms of the storage containers;

the first and third sets of pins being parallel and disposed in the same plane;

the second and third sets being parallel and disposed in spaced apart planes;

the pins in each set being separated by between one-quarter and three-quarters of an inch; and the closest pins from each of the first and third sets being separated by between 2-½ inches and 3 inches.

* * * * *